United States Patent [19]

Gat

[11] 4,227,358

[45] Oct. 14, 1980

[54] BUILDING ELEMENT FOR CONSTRUCTION OF INTERLOCKING GRIDS

[75] Inventor: Daniel Gat, Haifa, Israel

[73] Assignee: Technion Research & Development Foundation, Haifa, Israel

[21] Appl. No.: 964,434

[22] Filed: Nov. 28, 1978

[30] Foreign Application Priority Data

Aug. 21, 1978 [IL] Israel ..... 55404

[51] Int. Cl.[2] ..... E04H 12/00

[52] U.S. Cl. ..... 52/648; 52/664; 52/665; 52/720

[58] Field of Search ..... 52/648, 664, 665, 80, 52/81, 86, 93, 90, 92, 720; 403/217, 219, 169, 170, 178; 248/188.7

[56] References Cited

U.S. PATENT DOCUMENTS

| | | | |
|---|---|---|---|
| 1,678,435 | 7/1928 | Hunnelbeck | 52/664 |
| 2,607,959 | 8/1952 | Brosenius | 52/93 X |
| 3,943,672 | 3/1976 | O'Sheeran | 52/90 X |

FOREIGN PATENT DOCUMENTS

| | | | |
|---|---|---|---|
| 2551136 | 5/1977 | Fed. Rep. of Germany | 403/217 |
| 814613 | 3/1937 | France | 52/90 |
| 7603046 | 9/1977 | Netherlands | 52/664 |
| 994046 | 6/1965 | United Kingdom | 52/90 |

*Primary Examiner*—Alfred C. Perham
*Attorney, Agent, or Firm*—Browdy and Neimark

[57] ABSTRACT

A building element for the construction of self-supporting interlocking grids which may be used, for example, as floors or roofs, comprises a beam having a longitudinally protruding projection at each end, and having at least one recess of sufficient size to receive the longitudinally protruding projection from a second identical beam. The projection from a third such beam rests on the recess of the second, the projection of a fourth such beam rests in the recess of the third, and the projection of the first beam rests in the recess of the fourth. Thus, the four beams are rigidly connected in a statically determinate self-supporting manner. An entire grid of such joints may be made as well as light arched and domed roof structures.

16 Claims, 17 Drawing Figures

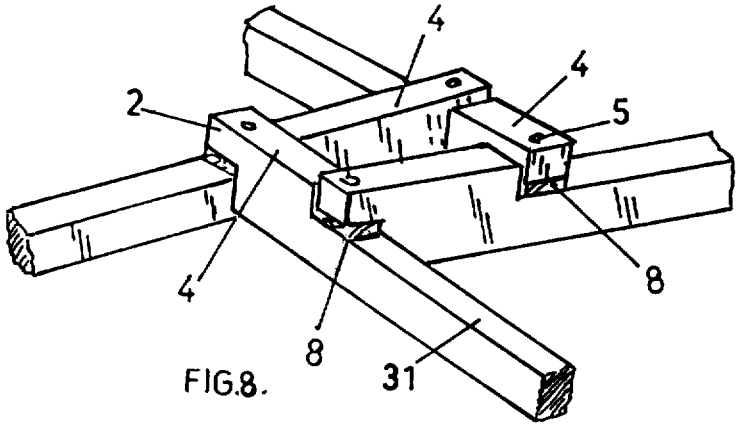
FIG.8.
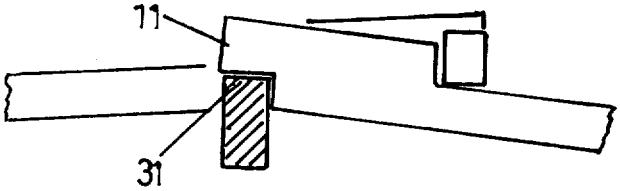
FIG. 9.
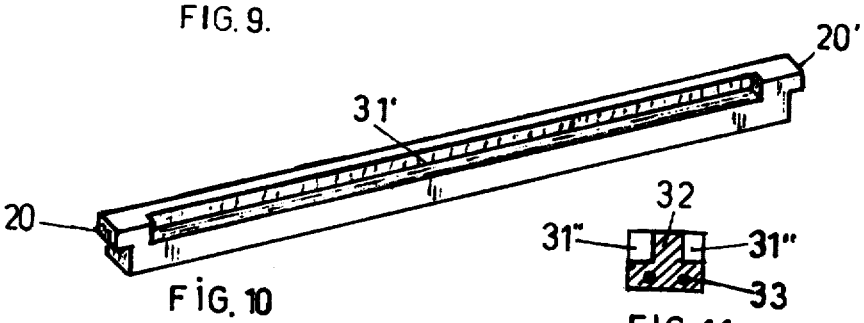
FIG. 10
FIG. 11.

BUILDING ELEMENT FOR CONSTRUCTION OF INTERLOCKING GRIDS

FIELD OF THE INVENTION

The present invention relates to a structural system for covering and enclosing space, and more particularly to the elements, grids and processes used in such a system for rigidly connecting identical beams or trusses without need for external joints.

BACKGROUND OF THE INVENTION

The erection of floors and roofs from prefabricated uniform elements is a well known practice, but nearly all the known systems depend on elements prefabricated for given spans and for rectangular floor plans with only slight deviations possible therefrom. Such systems as have been designed for irregular floor and roof plans require for their construction more than one kind of building element and are, therefore, complicated and require highly skilled labor.

SUMMARY OF THE INVENTION

It is therefore an object of the present invention to provide standardizable uniform building elements for the erection of floor and roof grids by largely unskilled labor.

It is a further object of the present invention to permit the erection of these structures without the need for shuttering and scaffolding.

Still another object of the present invention is the provision of uniform building elements for the construction of roofs and floors of irregular plans and various spans.

The present invention is accomplished by means of a self-supporting joint achieved by designing the communicating end of the beam with a sideward and upward protruding projection so that the beam may be woven under a second beam and over a third. By endowing both ends of the beam with this design, many beams can interact to form a self-supporting interlocking grid. Such a grid is rigid and need be supported at its outer rim only, provided that each participating member can withstand the resulting stress.

An element according to the present invention, used to form such joints for the construction of flat roof and floor grids, comprises a symmetrical beam, girder, or truss, which is provided in the upper portion of each end with a longitudinally protruding projection of a length preferably not greater than the width of the beam and of a vertical dimension less than the vertical dimension of the beam, girder or truss. The element is further provided with at least one, but not more than two, recesses made in its upper surface, of a width not less than the width of the projections and of a depth not more than half the vertical dimension of the beam, truss or girder at its ends. The recess or recesses extend longitudinally to an equal distance from each end of the element, which is greater than the protruding length of the projection.

Elements used for the construction of flat roof and floor grids are provided with recesses of a depth equal to the vertical dimensions of the protruding projections.

For the construction of vaulted roofs a similar type of beam, girder, or truss is used; but in this case the depth of the recess is less than the thickness of the projection.

In a preferred embodiment, the thickness of the beam between the recesses is reduced to the thickness at the bottom of the recesses, thus forming a beam with two end projections elevated above the upper surface of the central portion of the beam.

A floor or roof grid according to the present invention is composed of a plurality of uniform building elements which are positioned interlockingly at right angles to one another in that a projection of a first element is placed into, and supported by, a recess of a second element positioned at right angles to the first element, and a projection of the second element is placed into, and supported by, a recess of a third element positioned parallel with, and distanced from the first element, and so forth, thus forming a grid of adjacent rectangular fields, each in turn formed by four building elements. The grid is characterized by perpendicularly intersecting rows of building elements wherein each two consecutive elements in the same rows are separated by a distance equal to the distance between the projection and the recess, and is further characterized by the face that all consecutive elements in the same row are offset, in parallel alignment, by the distance between the projection and the recess at the same end of the element. Of course, the joints need not consist of four beams at right angles, but may, for example, consist of three beams at 60° angles, or six beams at 120° angles.

In a preferred embodiment, a floor or roof grid is constructed so as to include, on the one hand, large rectangular fields arranged in axisymmetricl configuration and, on the other hand, of small square fields positioned between the four adjoining rectangular fields surrounding each square field, the latter being formed by the end portions between projections and recesses of four interlocking elements.

BRIEF DESCRIPTION OF THE DRAWINGS

A better understanding of the present invention may be gained from the following description of preferred embodiments and the accompanying drawings which illustrate, by way of example, various alternatives of a standard building element and various ways of constructing floor and roof grids from such elements, and in which:

FIG. 8 is an isometric view of a joining area in a domed roof grid, the joint being formed by four elements of the embodiment shown in FIG. 3;

FIG. 9 is a side view of the joining area shown in FIG. 8, consisting of elements modified for the purpose;

FIG. 10 is a perspective view of an element with its center portion recesses on one side only;

FIG. 11 is a cross section through the center portion of an element with recesses on both sides;

DETAILED DESCRIPTION OF PREFERRED EMBODIMENTS

Figure 1:
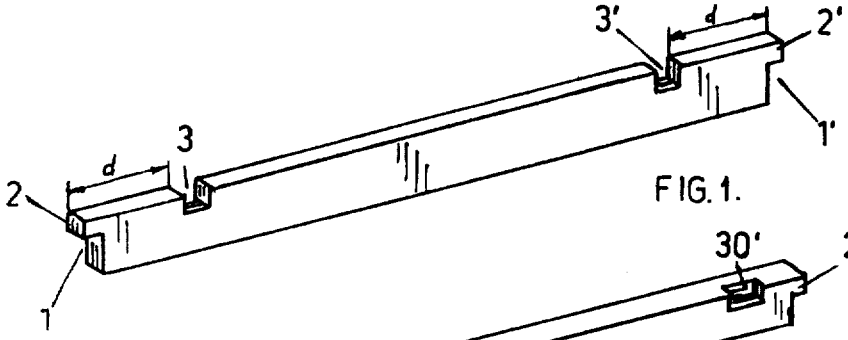
FIG. 1 shows a perspective view of an element with two full-width recesses.

The element shown in FIG. 1 comprises a beam of rectangular cross-section made of timber, steel, or any other suitable material, which beam is symmetrically rabbeted by rectangular cut-outs 1,1' in the lower parts of both of its ends, horizontal, longitudinally protruding projections 2, 2' of rectangular cross-section being left in the top portion of the beam ends. The protruding length of each projection 2, 2' is substantially equal to the width of the beam, while its width is likewise substantially equal to the width of the beam. Two rectangular recesses 3, 3' are provided in the upper face of the beam across its entire width and at a distance from the beam ends, this distance being determined by static calculations taking into account load, span, strength of material, and other factors. The width of each recess 3, 3' is not less than the width of the projections 2, 2', while their depth extends to the level of the bottom face of the projections, permitting the insertion of a projection of a second identical element into either recess.

Figure 2:
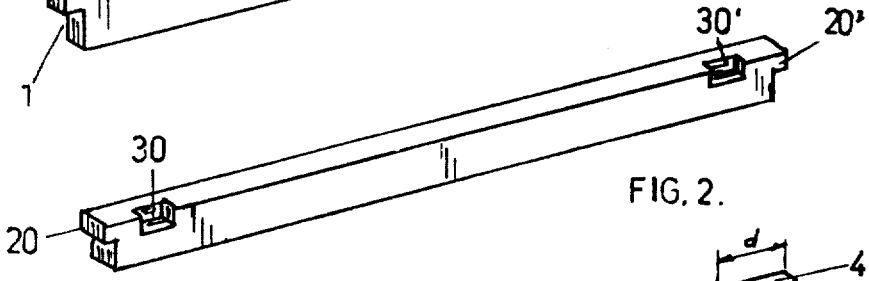
FIG. 2 shows a perspective view of an element with recesses on one side-face only.

The building element shown in FIG. 2 is similar to that of FIG. 1, with the difference that the beam width is greater than that of the aforedescribed element, and that the recesses 30, 30' do not extend across the entire beam width, but only to about half the width. Accordingly, the protruding length of the projection 20, 20' is less than the beam width, so that a projection 20, 20' of a first element can be inserted into a recess of a second element, as will be demonstrated hereinbelow.

Figure 3:
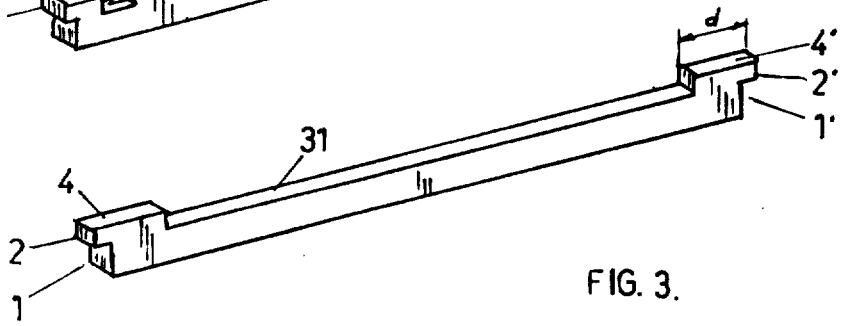
FIG. 3 shows a perspective view of an element with its central portion completely recessed, so as to reduce its thickness to that at the bottom of the recess.

The element of FIG. 3 is similar to that of FIG. 1, but is simplified by the recessing of the entire center portion 31 of the beam by a measure substantially equal to the thickness of a projection, leaving only two raised beam portions 4, 4' of length d at the ends of the elements.

The building element shown in FIG. 10 is a variation of the element shown in FIG. 2, obtained by extending a rectangular recess 31' all along the central portion of the element on one side face thereof. The recess 31' is, in fact, a continuation toward the center of the beam, of the two recesses 30 and 30' of FIG. 2.

FIG. 11 shows an element similar to that of FIG. 10, but here rectangular recesses 31" are provided on both sides of the element with a web portion 32 therebetween, thus forming a symmetrical cross section. This type of element would lend itself to fabrication from reinforced concrete, two reinforcement bars 33 being visible in the bottom portion.

Figure 4:
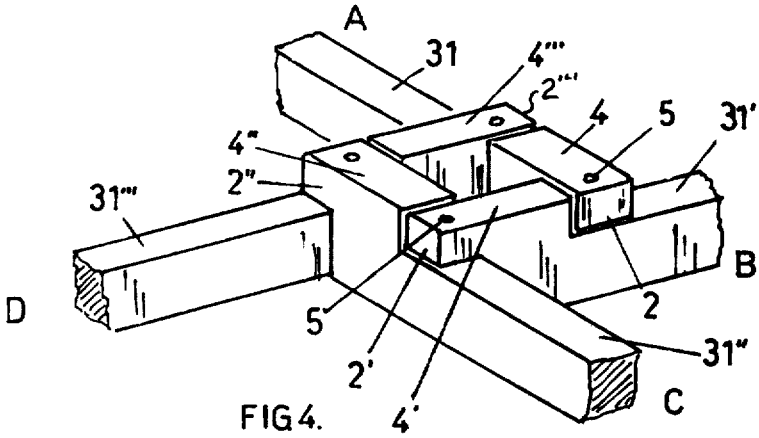
FIG. 4 shows a partially elevated view of the joining of four elements of the type shown in FIG. 3, to form a flat grid.

The assembly of a plurality of building elements of the present invention to form a flat grid is shown in FIG. 4, wherein for elements, A, B, C, and D, are joined to form one square field. The elements are those of FIG. 3, but the construction applies equally to the embodiments shown in FIGS. 1, 2, 10 and 11, respectively. Each element is supported by the element positioned at right angles to it; thus B supports A, C supports B, and so on, the projections 2, 2', 2" and 2"' being respectively supported by the recessed portions 31, 31', 31" and 31"' of the perpendicularly adjoining element. For reasons of static stability the projection of each element should be placed as close as possible to the back of the projection of the perpendicularly adjoining element. If elements of the type shown in FIGS. 1 and 2 are used, the projections should be lodged in the recessed 3, 3' and 30, 30' respectively. The four elements cross at right angles, and each two elements in a row, viz. A and C, and B and D, overlap and are staggered both approximately by the distance d.

The actual assembly work is readily carried out by supporting the end of a first element, say B, by a jack (not shown) and raising it to its correct level; then placing the projection 2 of element A into the recess end 31', then placing D on A, and finally threading C sideways between D and B so that it supports B and rests on D. The projections are secured in the recessed portions by nails, rivets, screws or bolts 5 inserted through preferably predrilled holes.

In this connection it is pointed out that the embodiment of FIGS. 3, 10 and 11, are preferable to the embodiments of FIGS. 1 and 2, because they permit the sideways shifting or swivelling of the last fourth element to be inserted, while the other types necessitate the more complicated operation of tilting to fit the fourth "locking" element into the recess.

Figure 5:
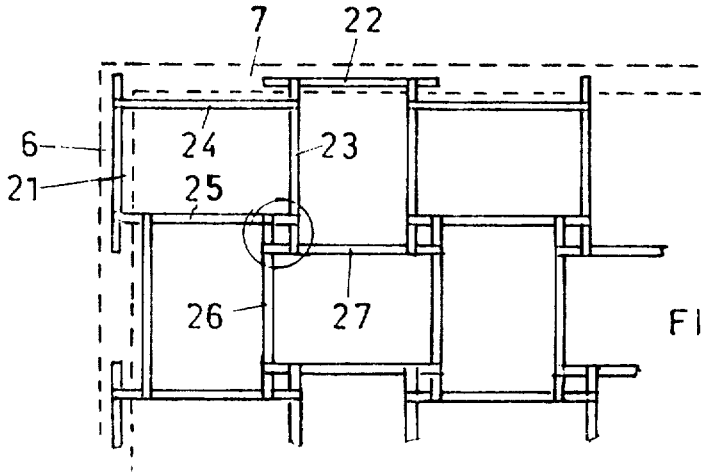
FIG. 5 is a plan view showing a corner of a grid of symmetrically arranged elements.

Assuming the connecting point to be the area shown encircled in FIG. 5, assembling it would require laying a first element 21 and a second element 22 on the walls 6 and 7, respectively, of the corner of a building (shown in broken lines). Now one end-projection of a third element 23 is placed on element 22 and its other end supported by a jack (not shown). Two further elements, 24 and 25, are now positioned so that their projections rest respectively on elements 21 and 23, and a joint is completed by adding two further elements 26, 27, the free ends of which are similarly supported and leveled by jacks, whereupon the jack under 23 can be removed. Assembly continues in a similar way, until the whole area enclosed by the wall is covered.

In temporary buildings the walls may be replaced by columns positioned at the corners of the outer elements.

Figure 6:
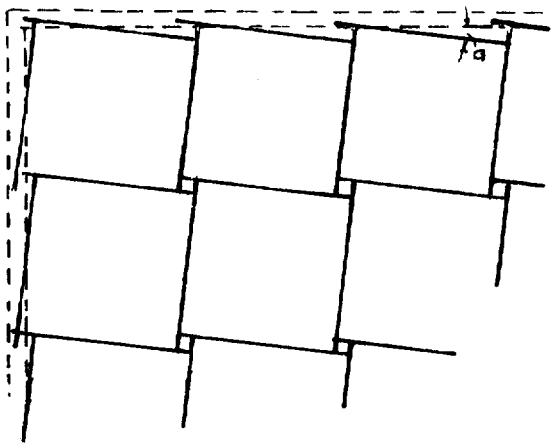
FIG. 6 is a plan view showing a corner of a grid composed of cyclically arranged elements.

The grid shown diagrammatically in FIG. 6 differs from that of FIG. 5 in that it contains cyclically positioned, staggered squares each formed of four uniform elements. The elements form an angle a with the walls, the size of which depends on the length of the elements and on the distance d between lug and recess.

Figure 7:
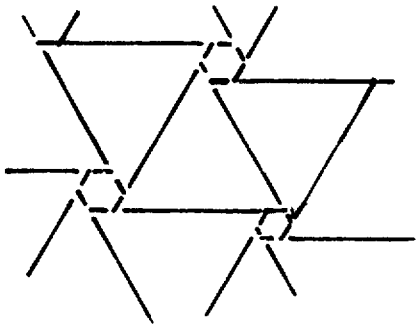
FIG. 7 is a plan view showing a portion of a grid of triangularly arranged elements.

A third type of grid is shown in FIG. 7 wherein staggered triangular fields are formed by three elements each, which intersect at an angle of 60°. Joining areas are hexagonal in shape, with six elements supporting each other at their respective ends, similarly as in the aforedescribed grids.

The completed grid is covered with suitably spaced joists which are subsequently covered by floor plates, floor boards, or other desired covering. The grid construction may be advantageously used for sloping roofs and may be covered with plates or provided with purlins or battens for laying roof tiles or slates.

The mode of construction is suitable also for arched and domed roofs. A joining area of a domed roof grid is shown in FIG. 8, wherein four standard elements meet in a square, similarly as in FIG. 4, but their four axes form the edges of a pyramid frustum sloping down from its square apex. This formed is obtained by placing wedges 8 between each projection and recess, which raises the projection above the upper surface 4 of the end portion. The side view of a joining point for a domed structure shows, in FIG. 9, a modification of the elements, wherein a projection 11 is downwardly extended by integrating in it the aforedescribed wedge 8 in a shape to fit into the recess 31 of a second element. A domed grid is assembled in a way similar to that described for a flat grid, by supporting the ends of not yet connected elements by jacks and continuing the assembling operation until the entire roof area is covered. By placing wedges underneath the projections of elements laid in one direction only and leaving the elements perpendicular thereto in their standard form as per FIGS. 1 to 3, an arched or "barrel" roof grid can be readily constructed. The grid form is not limited to the three aforedescribed embodiments; it is for instance, proposed to form large hexagonal fields with small triangular fields positioned at the corners, each formed by the end portions of three interlocking elements.

Figure 12:
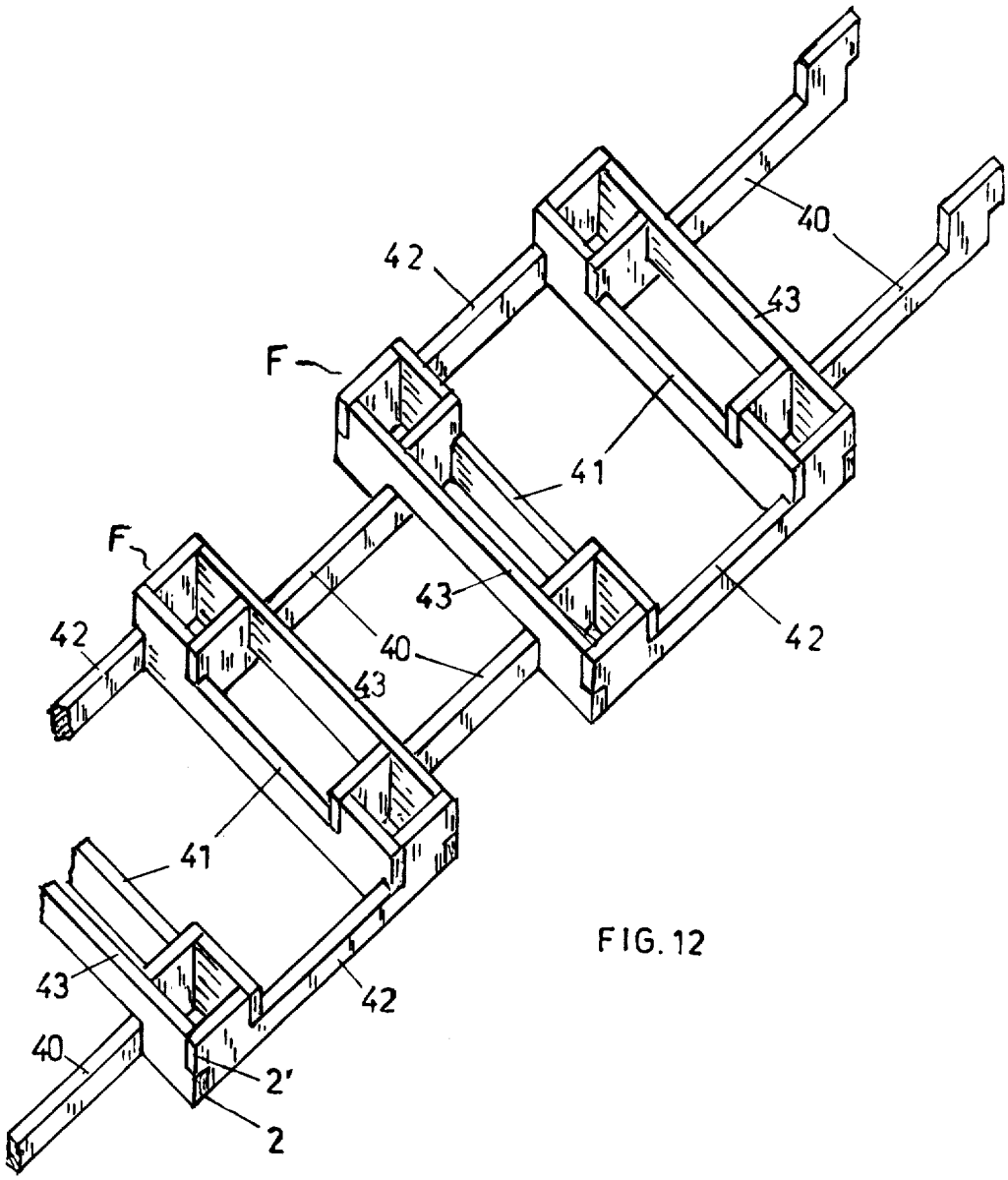
FIG. 12 is an isometric view of a bridge-like structure formed of the elements shown in FIG. 3.

A bridge-like structure can be built from standard elements as illustrated in FIG. 12 which shows a short section of such a structure. A bridge of this design will have to be supported at both its ends, no side supports being required, in contradistinction to the grids shown in FIGS. 5, 6 and 7, which require support all around. The bridge structure comprises a number of square fields, F, adequate for covering the span of the gap to be bridged, each two of which square fields are connected together by two longitudinally extending elements 40. Each field F is composed of two longitudinally extending elements 42 interconnected by two crosswise positioned elements 43, the latter being turned over so that their projections 2 are situated beneath the projections 2' of the two elements 42 and engaged in their respective cut-outs 1.

In the foregoing, the elements, for the sake of simplicity, have been shown to be in the form of solid beams, but in order to save weight the elements may be made in the form of steel trusses; they may be fabricated from hollow steel tubes or rectangular cross-section or from I or from other beans by welding the end projections onto the main body; they may be made of timber, extruded, aluminum sections, and the like.

Other configurations and materials may be devised or proposed by persons versed in the art without deviating from the principles here described by way of illustration and example.

The building elements, on a much reduced scale, may form part of an educational toy and construction game. The elements will be assembled, together with additionally supplied wall elements, columns and the like, to form floor and roof grids which can be covered by suitable plates or similarly as illustrated in FIG. 12, they may be assembled to form a toy bridge.

Figure 13:
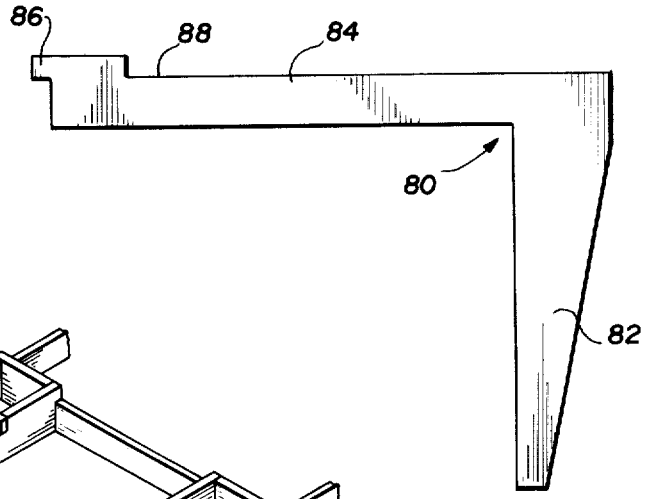
FIG. 13 is a side view of an L-shaped beam-column construction.

FIG. 13 shows a special "L" shaped beam-column combination 80. This elements includes a vertical portion 82 and a horizontal portion 84. One end of the vertical portion 82 is connected to one end of the horizontal portion 84. The opposite end of the horizontal portion 84 includes a projection 86 and a recess 88 similar to those discussed hereinabove with respect to the basic embodiment of the present invention.

Figure 14:
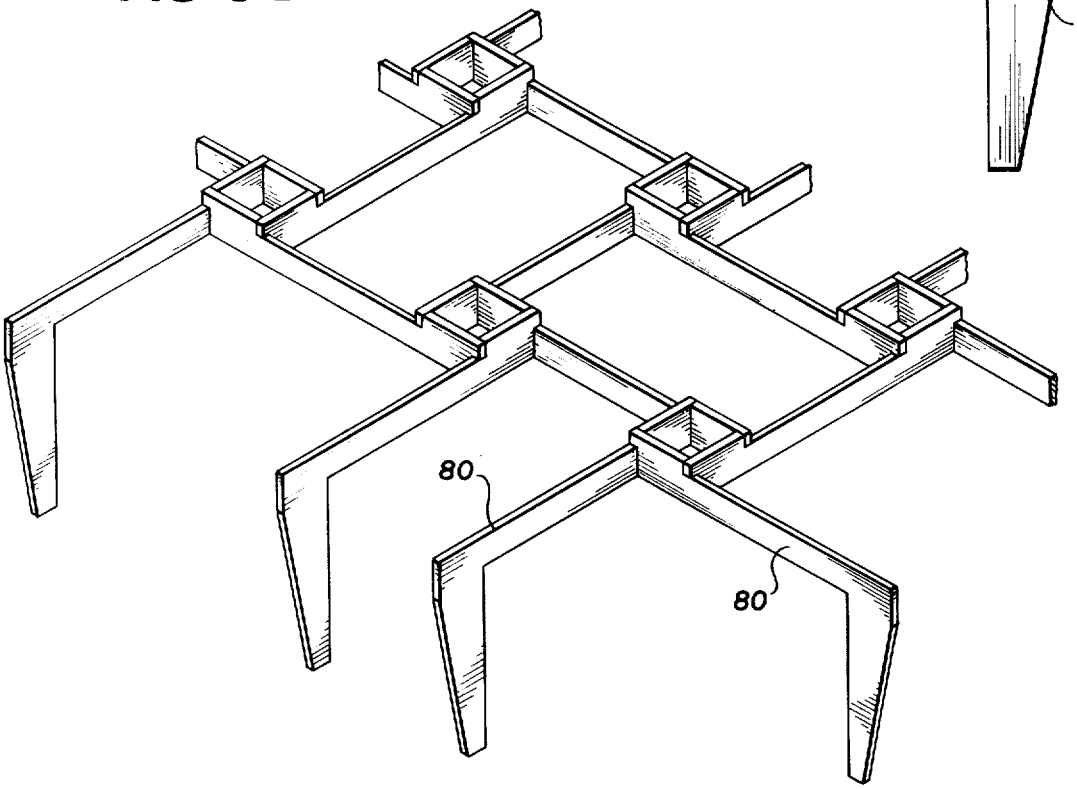
FIG. 14 is a perspective view of a grid in accordance with the present invention using the L-shaped element of FIG. 13.

FIG. 14 shows a grid arrangement in which the "L" shaped beam-column combination 80 may be used.

Figure 15:
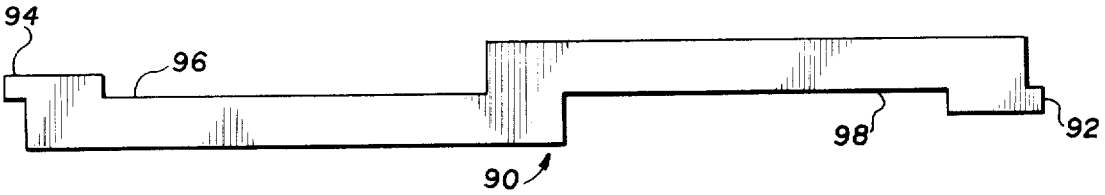
FIG. 15 is a side view of an S-type building element.

FIG. 15 shows another variation of the basic building element of the present invention. Here, an "S" shaped element 90 has two projections 92, 94 and two recesses 96, 98. However, projection 92 and recess 98 are inverted with respect to projection 94 and recess 96 on the opposite end of the element. These special "S" shaped elements 90 may be used to avoid columns or beams at specific joints within a grid as is shown in FIG. 16.

Figure 16:
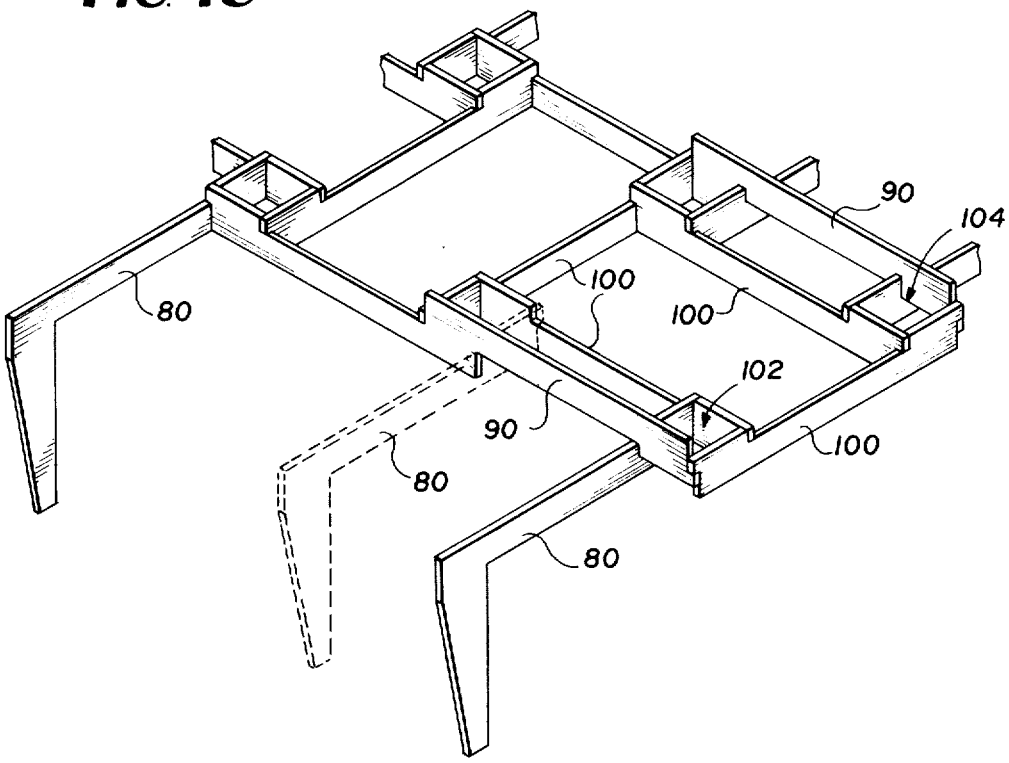
FIG. 16 is a perspective view of a building structure using the S-type element of FIG. 15.

The roof grid shown in FIG. 16 is supported by "L" shaped beam-column combinations 80. "S" shaped elements 90 are used at the front of the grid. It can be seen that due to the use of such elements the presence of columns or beams at joints 102 and 104 are eliminated, thus permitting a column-fee facade. It should be noted that the element 80 shown in dotted lines is redundant under the arrangement shown and may be eliminated if desired.

Figure 17:
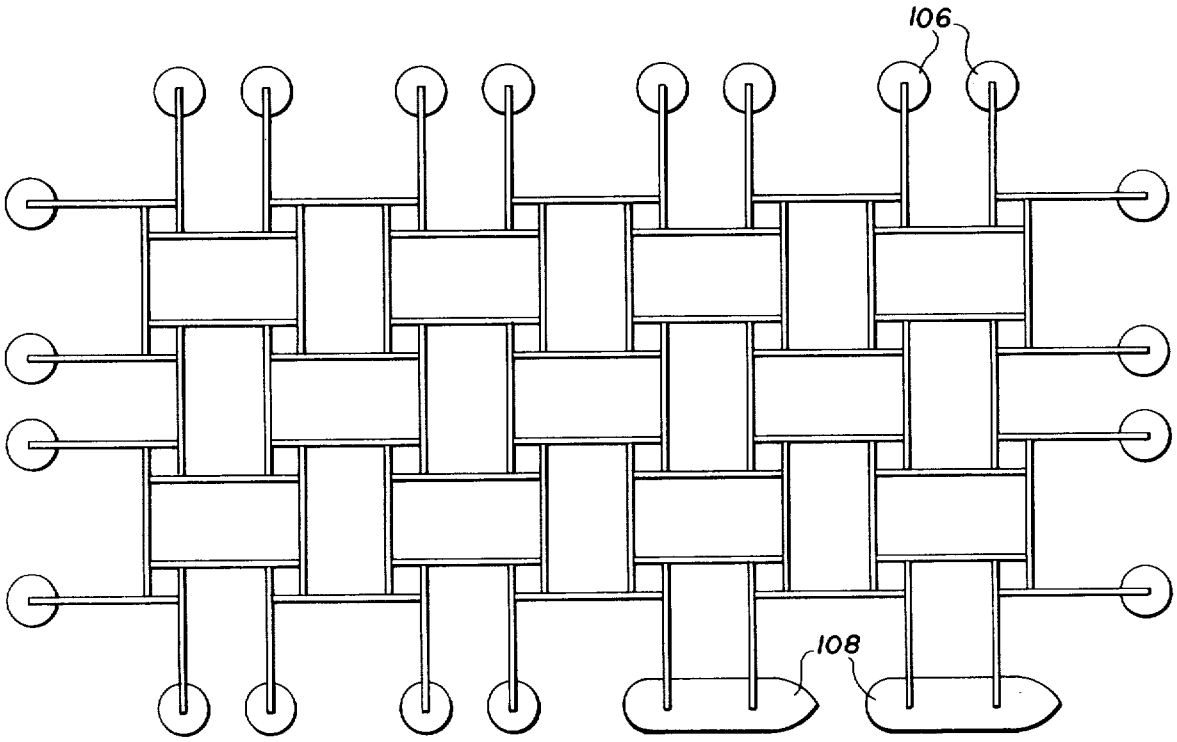
FIG. 17 is a plan view of a marine application of the present invention.

FIG. 17 shows a number of self-supporting interlocking joints forming a grid which is placed on pontoons 106 and floated on the water. Since the self-supporting interlocking grid is a statically determinate structure. the edge supports may undergo significant vertical displacement with no new internal stresses resulting and the inner grid members move up or down only slightly. Therefore, it is possible to place the grid on pontoons 106 and float it on water, even wavy water. The pontoons 106 may be at points or they could be linear, enjoining two or more support points as shown at 108.

The result is a floating structure with horizontal stability, resembling a catamaran. It could be used for any one of several marine purposes, as for example, a modular barge, a platform for marine or river operations, a water-borne landing strip, a pontoon bridge, etc.

It will be obvious to those skilled in the art that various changes may be made without departing from the scope of the invention and the invention is not to be considered limited to what is shown in the drawings and described in the specification.

What is claimed is:

1. A building element for the construction of floor and roof grids comprising: a beam, girder or truss having two ends and which is provided in the upper portion of at least one of said ends with a longitudinally protruding first projection of a vertical dimension less than the vertical dimension of the beam, girder or truss, the element being further provided with a first recessed portion disposed in its upper surface, of a width not less than the width of said projection and of a depth not more than half the vertical dimension of the beam, truss or girder at said ends, said first recess beginning a distance from said end of the element which is greater than the protruding length of the said first projection but which is small relative to the entire longitudinal length of the element, wherein said beam, girder or truss is symmetrical and is provided with a second protruding projection and a second recessed portion beginning at the other of said ends symmetrically disposed with respect to said first projection and said first recessed portion at said at least one end, and wherein said recessed portions beginning at each said end consist of a single central recess extending over the entire central portion of the element at equal depth.

2. A building element as defined in claim 1, wherein the widths of each of said projections equals the width of said ends of the beam, girder or truss.

3. A building element as defined in claim 2, wherein each said projection is of a continuous rectangular cross section, its top surface flush with the beam surface and its plane bottom surface parallel to the top surface at a distance therefrom not more than half the vertical dimention of said beam end, and wherein said recessed portions are of a depth, measured from the top surface, substantially equal to the vertical dimension of the said projections.

4. A building element as defined in claim 1, wherein said recessed portions extend across the entire width of the beam, girder or truss.

5. A building element as defined in claim 1, wherein the depth of said recessed portions is less than the height of said projections.

6. A building element as defined in claim 1, wherein said recessed portions are provided in one side face of the beam, extending from the top surface to a depth less than the vertical dimension of the beam.

7. A building element as defined in claim 1, wherein said first and second recessed portions are provided on both side faces of the beam extending from the top surface to a depth less than the vertical dimension of the beam and of a width less than half the width of the beam, thus, leaving a central web portion between two central recesses defined by respective pairs of said first and second recessed portions.

8. A building element as defined in claim 1, wherein said recessed portions at each end of the element have a width not substantially larger than the width of said projections.

9. A building element as defined in claim 8, wherein the depth of each said recessed portion equals the vertical dimension of said projections.

10. A building element as defined in claim 1, wherein said recessed portions are provided in one side face of the element extending from the top surface of the element to a depth less than the vertical dimension of the beam.

11. A floor or roof grid composed of a plurality of uniform building elements as defined in claim 1, which are positioned at right angles to one another and the end portions of which interlock in that a projection of a first element is laid into, and supported by a recess of a second element positioned at right angles to the said first element, a projection of the said second element being laid into, and supported by, a third element positioned parallel with and distanced from, the first element and so forth, the said grid thus consisting of adjacent rectangular fields each formed by four building elements, thereby forming perpendicularly intersecting rows of building elements, each two consecutive elements in the same row overlapping by the distance between the projection and the recess and all consecutive elements in the same row being staggered in parallel alignment by the distance between the projection and the recess at the same end of the element.

12. A grid as defined in claim 11 comprising large rectangular fields each formed by four elements arranged in axisymmetrical configuration, and small square fields positioned between each four adjoining rectangular fields, each small square field being formed by the end portions between lugs and recesses of four interlocking elements.

13. A grid as defined in claim 11 comprising large square fields, and small square fields each large square field formed by four elements, these square fields being adjacent and arranged in staggered configuration, and each small square field being positioned between each four adjacent large square fields and formed by the portions of four interlocking elements extending between said recesses and projections.

14. A grid composed of a plurality of building elements as defined in claim 1, comprising large triangular fields and small hexagonal fields, the latter positioned at the corners of six adjacent triangular fields, each triangular field being formed by three elements and each hexagonal field by the end portions between recesses and projections of six interlocking elements.

15. A vaulted roof grid in arched or domed configuration composed of a plurality of building elements as defined in claim 1 and arranged in the form of rectangular, square, or triangular fields, wherein a wedge is positioned between the underside of a projection and the bottom of the accommodating recess.

16. An elongated structure composed of a plurality of building elements as defined in claim 1 arranged in a number of square fields, each composed of two longitudinal elements and four transversely positioned elements rigidly connecting the said two longitudinal elements, the two transversal elements farthest from each other being turned over so that their projections engage with the projections of the two longitudinal elements and the two transversal elements nearest to each other being placed over the two longitudinal elements, each two square fields being connected together by two longitudinally extending elements engaging the recesses of the transversely positioned elements.

* * * * *